US008944019B2

(12) United States Patent
Hiramatsu

(10) Patent No.: US 8,944,019 B2
(45) Date of Patent: Feb. 3, 2015

(54) VARIABLE VALVE MECHANISM

(71) Applicant: Otics Corporation, Nishio (JP)

(72) Inventor: Naoki Hiramatsu, Nishio (JP)

(73) Assignee: Otics Corporation, Nishio-Shi, Aichi-Ken (JP)

( * ) Notice: Subject to any disclaimer, the term of this patent is extended or adjusted under 35 U.S.C. 154(b) by 46 days.

(21) Appl. No.: 13/844,909

(22) Filed: Mar. 16, 2013

(65) Prior Publication Data

US 2013/0263804 A1 Oct. 10, 2013

(30) Foreign Application Priority Data

Apr. 10, 2012 (JP) ..... 2012-089621

(51) Int. Cl.
*F01L 1/34* (2006.01)
*F01L 1/18* (2006.01)
*F01L 13/00* (2006.01)

(52) U.S. Cl.
CPC . *F01L 1/34* (2013.01); *F01L 1/185* (2013.01); *F01L 13/0005* (2013.01); *F01L 13/0036* (2013.01); *F01L 2105/00* (2013.01)
USPC ..... 123/90.16; 123/90.44

(58) Field of Classification Search
CPC ..... F01L 1/185; F01L 13/0005; F01L 1/34; F01L 13/0036; F01L 2105/00
USPC ..... 123/90.16, 90.44
See application file for complete search history.

(56) References Cited

U.S. PATENT DOCUMENTS

RE33,411 E * 10/1990 Inoue et al. ..... 123/90.44
6,755,167 B2 6/2004 Krieg et al.
7,322,324 B2 * 1/2008 Hara et al. ..... 123/90.16
8,033,260 B2 * 10/2011 Reinecke-Murmann et al. ..... 123/90.16
2003/0159666 A1 8/2003 Krieg et al.
2004/0003789 A1 1/2004 Kreuter
2005/0132990 A1 6/2005 Haas et al.
2009/0178637 A1 * 7/2009 Gecim et al. ..... 123/90.39
2009/0199800 A1 8/2009 Reinicke-Murmann et al.
2009/0293824 A1 * 12/2009 Hwang ..... 123/90.16
2010/0162979 A1 7/2010 Kreuter et al.

FOREIGN PATENT DOCUMENTS

DE 102004048289 A1 4/2006
JP 2003-254024 A 9/2003
JP 2008-208746 A 9/2008

OTHER PUBLICATIONS

European Search Report dated Jun. 25, 2013.

* cited by examiner

*Primary Examiner* — Thomas Denion
*Assistant Examiner* — Ngoc T Nguyen
(74) *Attorney, Agent, or Firm* — McGinn IP Law Group, PLLC

(57) ABSTRACT

The present invention provides a variable valve mechanism of an internal combustion engine which includes a rotary cam, an output arm, an input member, and a switching device that switches between a coupled state and a non-coupled state. The variable valve mechanism changes a drive state of the valve by the switching operation. The input member includes an annular input roller that contacts the rotary cam, and a swing pin that is inserted into the input roller so as to rotatably support the input roller and that swings relative to the output arm when in the non-coupled state. A center of the relative swinging movement is located at a position different from a rotation center of the input roller which is located inward of the input roller.

9 Claims, 9 Drawing Sheets

VARIABLE VALVE MECHANISM

TECHNICAL FIELD

The present invention relates to variable valve mechanisms that switch the drive state of a valve according to the operating condition of an internal combustion engine.

BACKGROUND ART

A variable valve mechanism 90 of Patent Literature 1 (Related Art Document 1) shown in FIG. 8, a variable valve mechanism 90' of Patent Literature 2 (Related Art Document 2) shown in FIG. 9, variable valve mechanisms of Patent Literature 3 and Patent Literature 4 (Related Art Documents 3 and 4), not shown, etc. are known as valve mechanisms having a halt function to halt driving of a valve and a variable function such as an working-angle variable function to vary the working angle, etc.

These variable valve mechanisms 90, 90' are configured to include: a rotary cam 91 that rotates according to rotation of an internal combustion engine; an output arm 92 that is swingably provided and that drives a valve 7 when swinging; an input arm 93 that is provided so as to be swingable relative to the output arm 92, and that includes an input roller 98 contacting the rotary cam 91; and a switching device 94 that switches between a coupled state where the output arm 92 is coupled to the input arm 93 so as not to allow the input arm 93 to swing relative to the output arm 92 and a non-coupled state where the coupling between the output arm 92 and the input arm 93 is released so as to allow the input arm 93 to swing relative to the output arm 92. The variable valve mechanisms 90, 90' change the drive state of the valve 7 by the switching operation.

CITATION LIST

Patent Literature

Patent Literature 1: United State Patent Application Publication No. 2005/132990

Patent Literature 2: Japanese Patent Application Publication No. 2008-208746 (JP 2008-208746 A)

Patent Literature 3: Japanese Patent Application Publication No. 2003-254024 (JP 2003-254024 A)

Patent Literature 4: German Patent Application Publication No. 102004048289

SUMMARY OF THE INVENTION

Technical Problem

According to the variable valve mechanisms of Related Art Documents 1 to 4, the drive state of the valve 7 can be switched by switching between the coupled state and the non-coupled state. However, the input arm 93 (input member) that swings relative to the output arm 92 is required in addition to the output arm 92 as a main element. This increases the size of the variable valve mechanism and complicates the structure thereof, thereby causing an increase in cost.

It is an object of the present invention to configure in a simple and compact manner an input member that swings relative to an output arm.

Solution to Problem

To achieve the object described above, a variable valve mechanism of the present invention includes: a rotary cam that rotates according to rotation of the internal combustion engine; an output arm that is swingably provided, and that drives a valve when swinging; an input member that is provided so as to be swingable relative to the output arm, and that contacts the rotary cam; and a switching device that switches between a coupled state where the input member is coupled to the output arm so as not to allow the input member to swing relative to the output arm, and a non-coupled state where the coupling between the input member and the output arm is released so as to allow the input member to swing relative to the output arm, wherein the variable valve mechanism changes a drive state of the valve by the switching operation, the input member is formed by an annular input roller that contacts the rotary cam, and a swing pin that is inserted into the input roller so as to rotatably support the input roller, and that swings relative to the output arm when in the non-coupled state, and a center of the relative swinging movement is located at a position different from a rotation center of the input roller which is located inward of the input roller.

Although the configuration and position of the switching device are not particularly limited, it is preferable that the switching device include a switch pin that extends in both the swing pin and the output arm when in the coupled state and that does not extend in both the swing pin and the output arm when in the non-coupled state. In the coupled state, it is preferable that a center of the switch pin be located at a position different from a center of the relative swinging movement which is located inward of the input roller. This configuration makes the input member simple and compact.

The positional relation between the center of the relative swinging movement and the center of the switch pin is not particularly limited. However, in the coupled state, it is preferable that the center of the relative swinging movement and the center of the switch pin be located on the opposite sides of the rotation center of the input roller. Separating the center of the relative swinging movement from the center of the switch pin allows for enough space. More specifically, it is preferable that the center of the relative swinging movement, the rotation center of the input roller, and the center of the switch pin be aligned in line.

Although the swing pin and the center of the relative swinging movement are not particularly limited, the swing pin may be supported by the output arm via a support pin and a center of the support pin maybe the center of the relative swinging movement.

Although the support pin and the input member when in the non-coupled state are not particularly limited, it is preferable that the support pin protrude laterally from the output arm, and a torsion coil spring that biases the input member against the rotary cam when in the non-coupled state be fitted on the laterally protruding portion of the support pin. This configuration can make a rocker arm compact.

Although a maximum displacement amount by which the input member can be displaced relative to the output arm by the relative swinging movement is not particularly limited, making the maximum displacement amount larger than a lift amount of the rotary cam allows the driving of the valve to be completely halted when in the non-coupled state. Alternatively, making the maximum displacement amount smaller than the lift amount of the rotary cam allows the valve to be driven by a smaller drive amount than that in the coupled state when in the non-coupled state.

Although a bearing between the input roller and the swing pin is not particularly limited, the bearing may be a slide bearing that is implemented by slidably supporting the input roller by the swing pin, or may be a rolling bearing that is implemented by interposing a bearing such as a roller bearing or a ball bearing between the input roller and the swing pin.

Advantageous Effects of Invention

According to the present invention, the swing center of the input member is provided inward of the input roller, which makes the input member simple and compact.

DESCRIPTION OF EMBODIMENTS

First Embodiment

Figure 1:
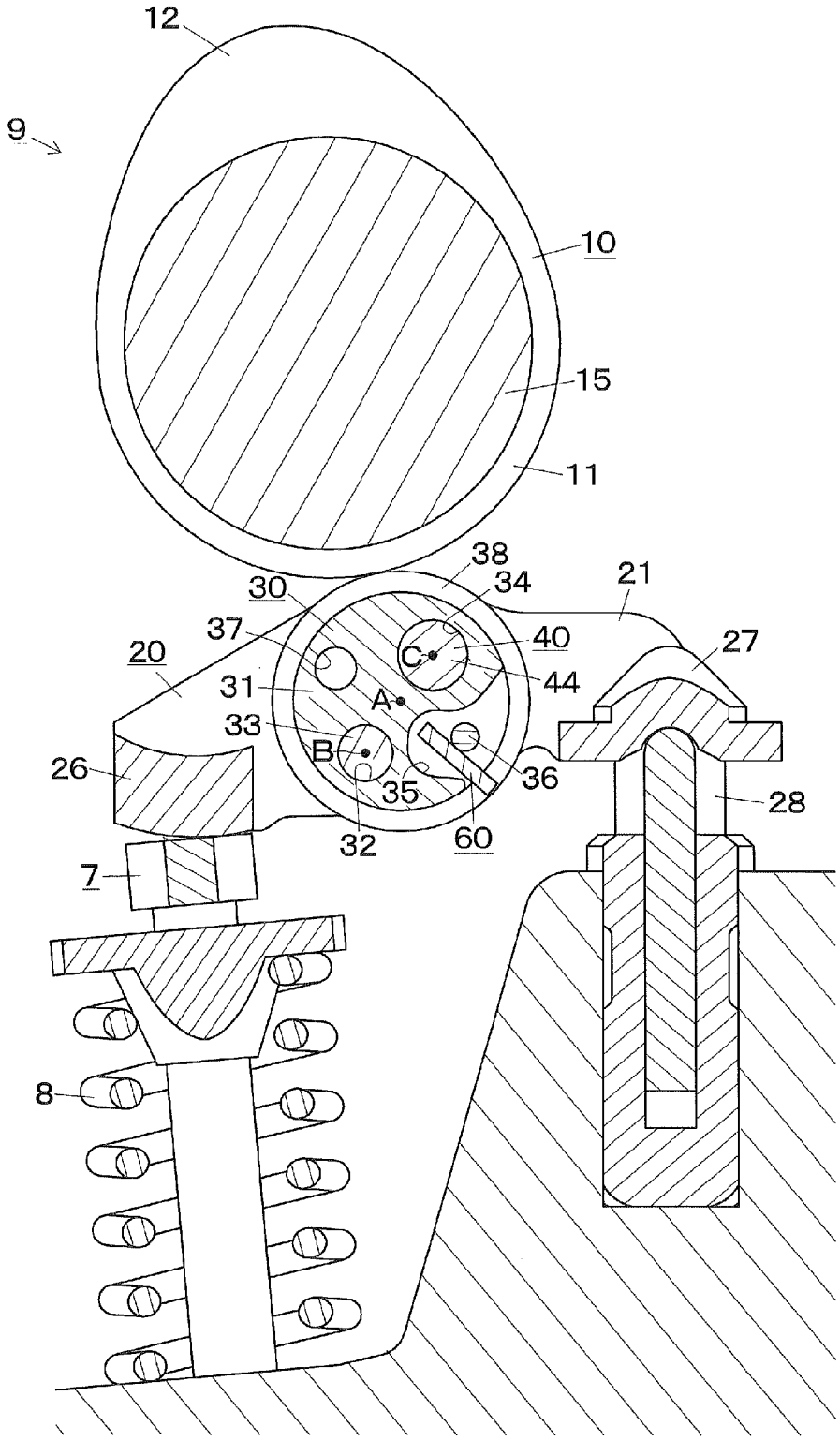
FIG. 1 is a side sectional view showing a variable valve mechanism according to a first embodiment of the present invention.
Figure 2:
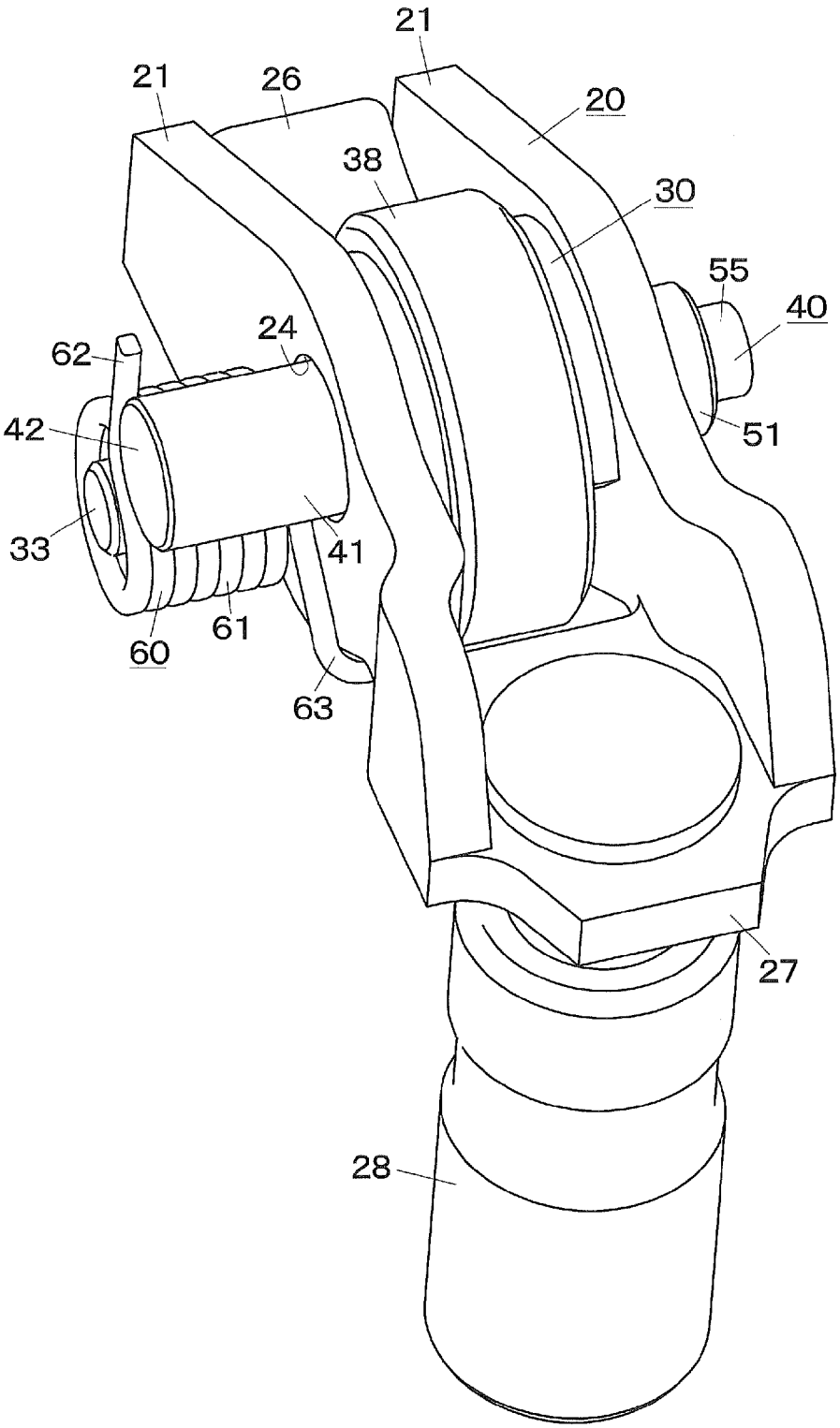
FIG. 2 is a perspective view showing the variable valve mechanism of the first embodiment.
Figure 3A:
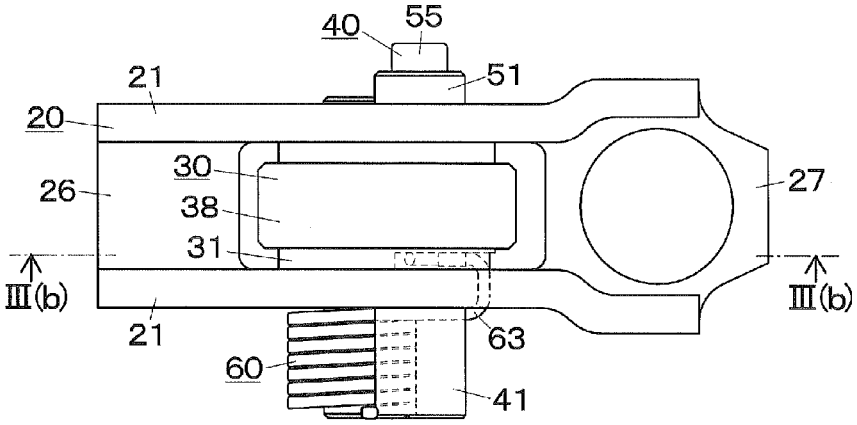
FIG. 3A is a plan view showing the variable valve mechanism of the first embodiment.
Figure 3B:
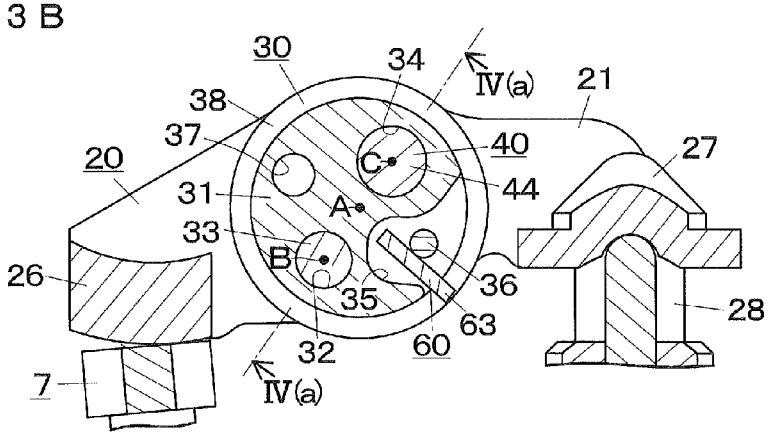
FIG. 3B is a side sectional view thereof.
Figure 3C:
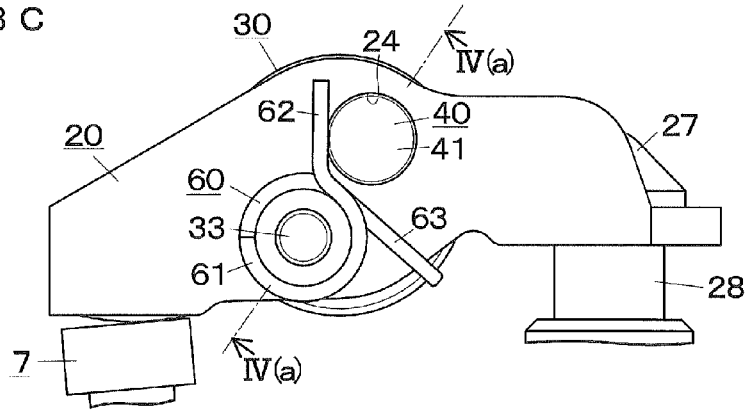
FIG. 3C is a side view thereof.

A variable valve mechanism 9 of an internal combustion engine according to a first embodiment of the present invention shown in FIGS. 1 to 6B is provided for a valve 7 having a valve spring 8 attached thereto, and includes a rotary cam 10, an output arm 20, an input member 30, a switching device 40, and a torsion coil spring 60, which will be described below. In the following description, "left" refers to one side in the direction of a swing axis of the output arm 20, and "right" refers to the other side in the direction of the swing axis. However, "left" and "right" may be reversed.

[Rotary Cam 10]

The rotary cam 10 is provided on a cam shaft 15 extending in a lateral direction, and rotates together with the cam shaft 15 according to rotation of the internal combustion engine. This rotary cam 10 includes a base circle 11 having a true circular cross section, and a cam nose 12 protruding from the base circle 11.

[Output Arm 20]

The output arm 20 is formed by two outer arm portions 21, 21 that are arranged next to each other at an interval in the lateral direction, a front end 26 coupling front ends of the outer arm portions 21, 21, and a rear end 27 coupling rear ends of the outer arm portions 21, 21. The front end 26 contacts a stem end of the valve 7, and the rear end 27 is swingably supported by a lash adjuster 28. A support hole 23 and an attachment hole 24, both having a circular cross section, are formed so as to extend through an intermediate portion in a longitudinal direction of each outer arm 21.

[Input Member 30]

The input member 30 includes an annular input roller 38 contacting the rotary cam 10, and a swing pin 31 inserted into the input roller 38 so as to rotatably support the input roller 38. The swing pin 31 is a cylindrical member having a circular cross section and extending in the lateral direction. A supported hole 32 extending in the lateral direction is formed so as to extend through the swing pin 31 at a position different form the center of the swing pin 31 (the rotation center A of the input roller 38). A single support pin 33 is inserted into both the supported hole 32 and the support holes 23, 23 of the output arm 20, so that the input member 30 is supported so as to be swingable relative to the output arm 20. A left end of the support pin 33 protrudes leftward of the left outer arm portion 21.

A coupled hole 34 having a circular cross section and extending in the lateral direction is formed so as to extend through the swing pin 31 at a position located on the opposite side of the rotation center A of the input roller 38 from the support pin 33. Switch pins 44, 54, described below, of the switching device 40 are inserted into the coupled hole 34. Accordingly, in a coupled state described below, the center of the support pin 33 (the center B of the relative swinging movement), the center of the swing pin 31 (the rotation center A of the input roller 38), and the center C of the switch pins 44, 45 are aligned in line. A recess 35 communicating with an outer peripheral surface of the swing pin 31 is provided in a left end face of the swing pin 31, and a pressed protrusion 36 that is to be pressed by the torsion coil spring 60 is provided on a bottom surface of the recess 35 so as to protrude therefrom. A weight-reducing hole 37 that reduces the weight of the swing pin 31 or balances the mass of the swing pin 31 is provided so as to extend through the swing pin 31.

[Switching Device 40]

The switching device 40 is a device that switches between a coupled state where the input member 30 is coupled to the output arm 20 so as not to allow the input member 30 to swing relative to the output arm 20, and a non-coupled state where the coupling between the input member 30 and the output arm 20 is released so as to allow the input member 30 to swing relative to the output arm 20. The switching device 40 includes a first coupling member 41, the first switch pin 44, a return spring 48, a second coupling member 51, the second switch pin 54, an intervening pin 55, and a displacing device 58, which will be described below.

The first coupling member 41 is a bottomed cylindrical member having a bottom 42, and a cylindrical hole inside the first coupling member 41 serves as a first coupling hole 43. The first coupling member 41 is attached to the attachment hole 24 of the left outer arm portion 21 so that an opening of the first coupling member 41 faces rightward and that the bottom 42 at a left end of the first coupling member 41 protrudes leftward from the attachment hole 24. The first switch pin 44 is inserted into the first coupling hole 43 so as to be displaceable between a coupling position where the first switch pin 44 extends in both the first coupling hole 43 and the coupled hole 34 of the input member 30, and a non-coupling position where the first switch pin 44 does not extend in both the first coupling hole 43 and the coupled hole 34 of the input member 30. The return spring 48 is interposed between the bottom 42 at a left end of the first coupling hole 43 and a left end face of the first switch pin 44, and presses the first switch pin 44 rightward by its restoring force.

The second coupling member 51 is a cylindrical member without a bottom, and a cylindrical hole inside the second coupling member 51 serves as a second coupling hole 53. The second coupling member 51 is attached to the attachment hole 24 of the right outer arm portion 21 so that a right end of the second coupling member 51 protrudes rightward from the attachment hole 24. The second coupling member 51 has a stopper 52 at its right opening in order to prevent the intervening pin 55 from excessively protruding rightward. The second switch pin 54 is inserted into the coupled hole 34 of the input member 30 so as to be displaceable between a coupling position where the second switch pin 54 extends in both the coupled hole 34 and the second coupling hole 53, and a non-coupling position where the second switch pin 54 does not extend in both the coupled hole 34 and the second coupling hole 53. The intervening pin 55 is inserted into the second coupling hole 53 such that the intervening pin 55 can protrude rightward from the right opening of the second coupling member 51.

The displacing device 58 includes a pressing portion 59 that contacts a right end face of the intervening pin 55 from the right side, and a main body (not shown) that advances the pressing portion 59 leftward and withdraws the pressing portion 59 rightward. The displacing device 58 may be a hydraulic displacing device that advances and withdraws the pressing portion 59 by a hydraulic pressure, or may be an electromagnetic displacing device that advances and withdraws the pressing portion 59 by a magnetic force.

[Torsion Coil Spring 60]

The torsion coil spring 60 is a lost motion spring that biases the input member 30 against the rotary cam 10 when in the non-coupled state so that the input roller 38 follows the rotary cam 10 even in the non-coupled state. A coil-shaped portion 61 in an intermediate portion in the longitudinal direction of the torsion coil spring 60 is fitted on the left end of the support pin 33. One end 62 of the torsion coil spring 60 contacts an outer peripheral surface of the first coupling member 41. The other end 63 of the torsion coil spring 60 contacts an outer peripheral surface of the pressed protrusion 36 of the swing pin 31. In the coupled state, the torsion coil spring 60 biases the input member 30 against the output arm 20 via the coupling pins 44, 54.

The variable valve mechanism 9 in the following two states during operation of the internal combustion engine will be described below. [1] In the coupled state where the input member 30 is coupled to the output arm 20, and [2] in the non-coupled state where the coupling between the input member 30 and the output arm 20 is released.

[1] In the Coupled State

Figure 4B:
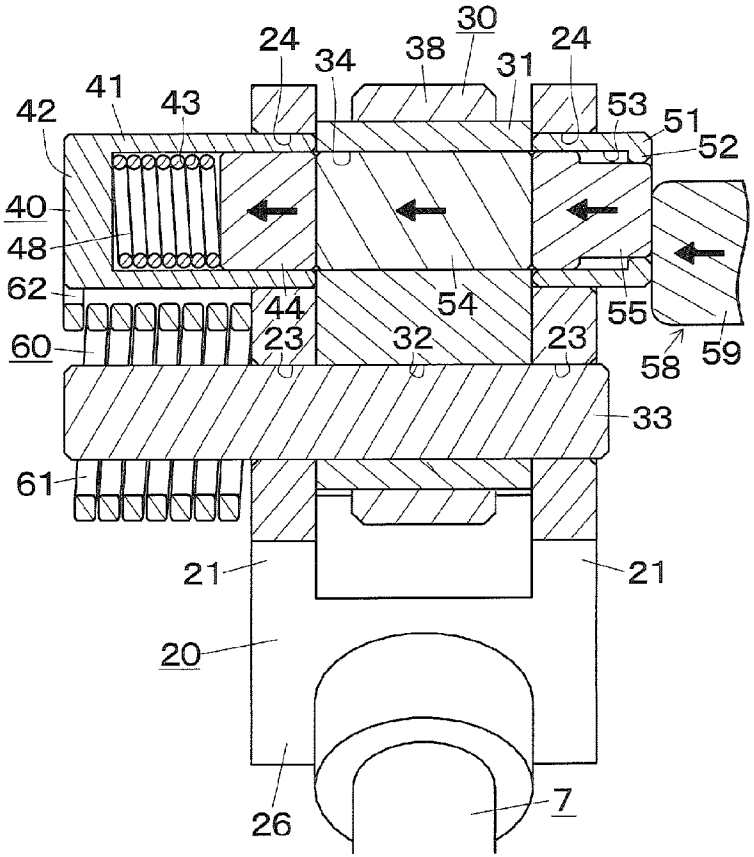
FIG. 4B is a front sectional view showing a non-coupled state thereof.
Figure 4A:
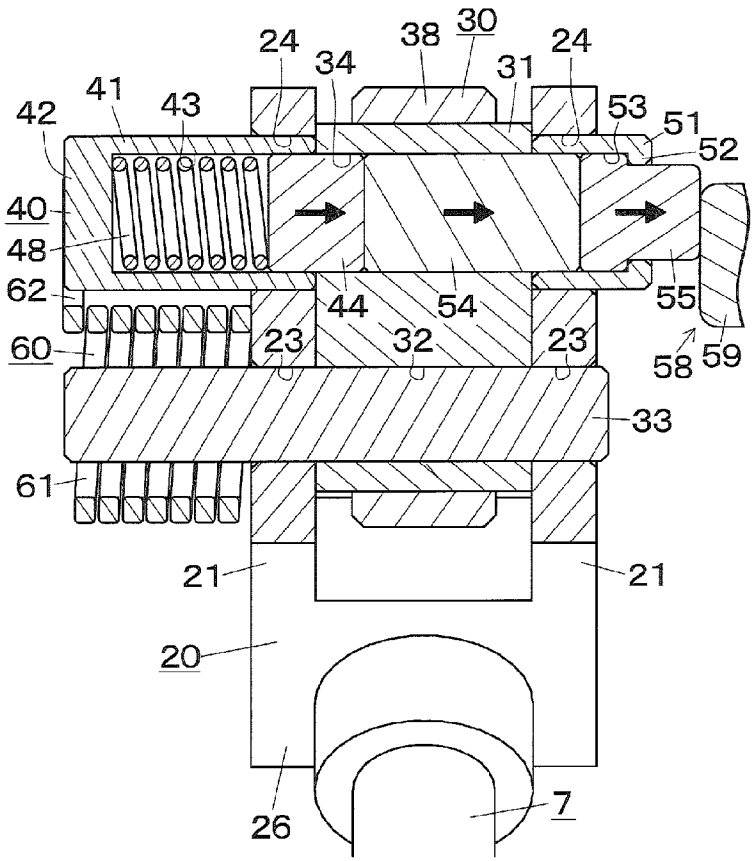
FIG. 4A is a front sectional view showing a coupled state of the variable valve mechanism of the first embodiment.
Figure 5B:
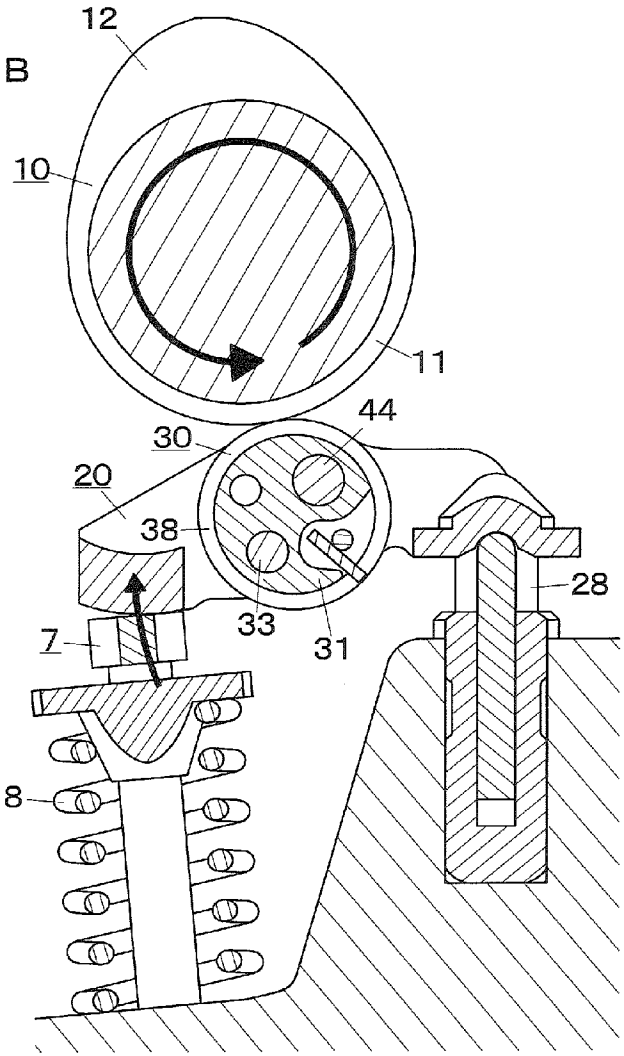
FIG. 5B is a side sectional view showing a state where the input member contacts a base circle when in the coupled state of the variable valve mechanism of the first embodiment.
Figure 5A:
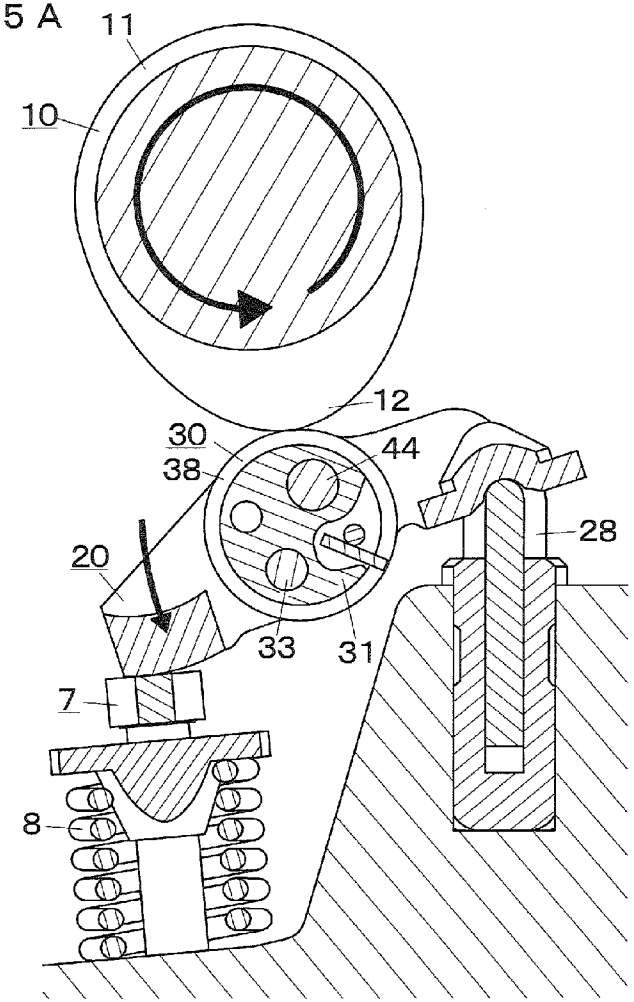
FIG. 5A is a side sectional view showing a state where an input member contacts a cam nose when in the coupled state of the variable valve mechanism of the first embodiment.

In the coupled state, as shown in FIG. 4A, the pressing portion 59 of the displacing device 58 does not press the intervening pin 55 leftward, whereby the first switch pin 44, the second switch pin 54, and the intervening pin 55 are displaced rightward by the restoring force of the return spring 48, and the first switch pin 44 and the second switch pin 54 are placed at the coupling position. Thus, the input member 30 is supported at two points with respect to the output arm 20 by the support pin 33 and the switch pins 44, 54, so that the input member 30 is not allowed to swing relative to the output arm 20. Accordingly, as shown in FIGS. 5A and 5B, the output arm 20 swings together with the input member 30 to drive the valve 7.

[2] In the Non-Coupled State

Figure 6B:
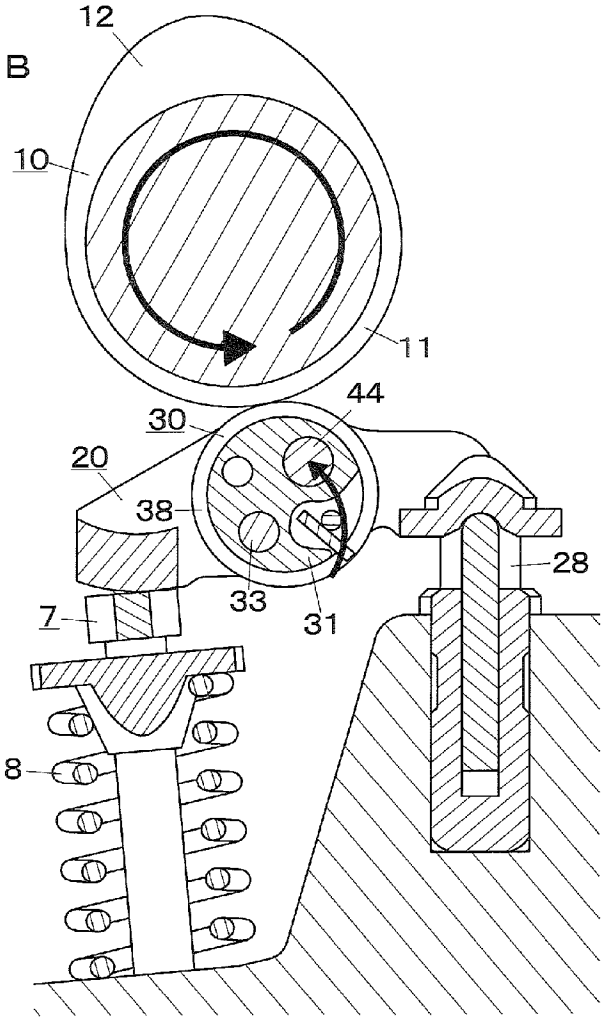
FIG. 6B is a side sectional view showing a state where the input member contacts the base circle when in the non-coupled state of the variable valve mechanism of the first embodiment.
Figure 6A:
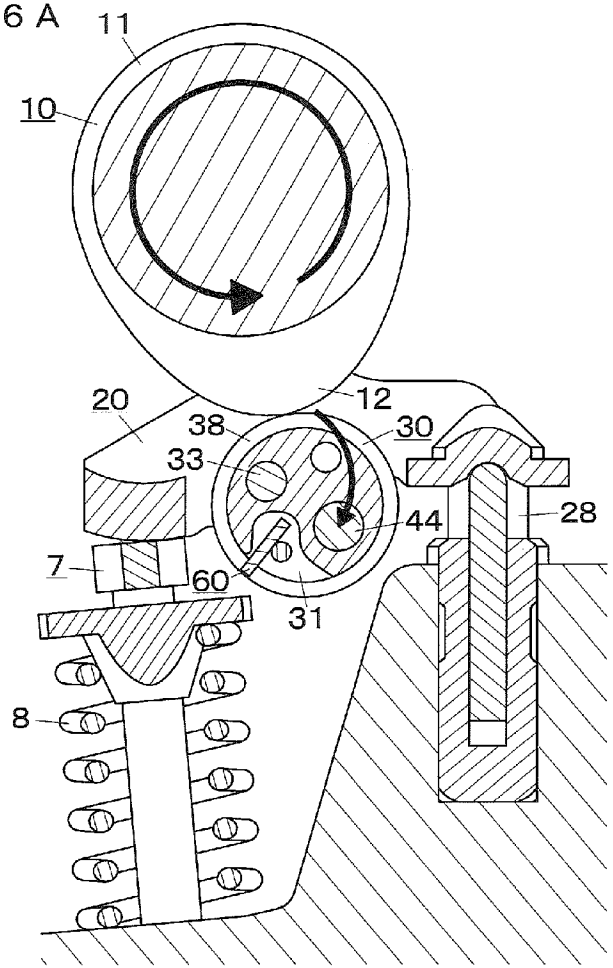
FIG. 6A is a side sectional view showing a state where the input member contacts the cam nose when in the non-coupled state of the variable valve mechanism of the first embodiment.

In the non-coupled state, as shown in FIG. 4B, the pressing portion 59 of the displacing device 58 presses the intervening pin 55 leftward, whereby the first switch pin 44, the second switch pin 54, and the intervening pin 55 are displaced leftward against the restoring force of the return spring 48, and the first switch pin 44 and the second switch pin 54 are placed at the non-coupling position. Thus, the input member 30 is supported at one point with respect to the output arm 20 by only the support pin 33, so that the input member 30 is allowed to swing relative to the output arm 20 about the support pin 33. Accordingly, as shown in FIGS. 6A and 6B, only the input member 30 swings about the support pin 33, and the output arm 20 does not swing. Thus, the driving of the valve 7 is halted.

According to the first embodiment, the swing center of the input member 30 and the centers of the switch pins 44, 54 are provided inward of the input roller 38 rather than outward thereof, which makes the input member 30 simple and compact. This can improve mountability of the variable valve mechanism 9 on the internal combustion engine, and can achieve reduction in cost.

Figure 7A:
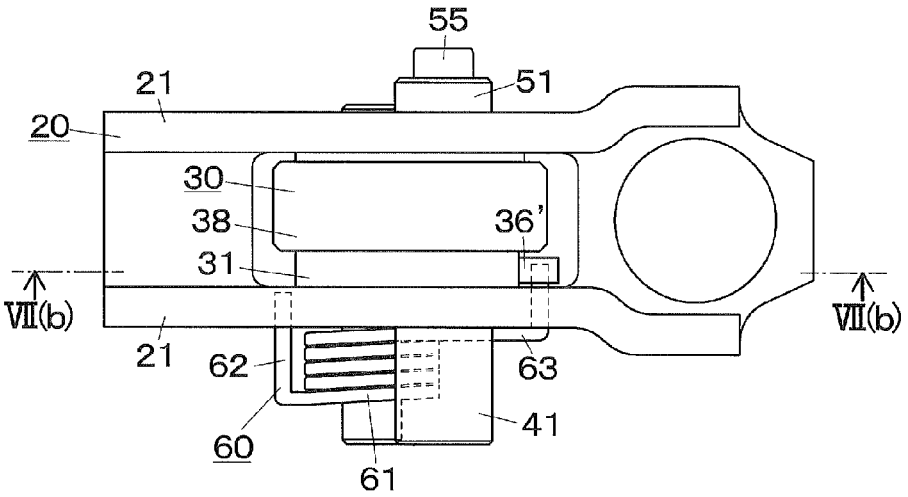
FIG. 7A is a plan view showing a variable valve mechanism of a second embodiment.
Figure 7B:
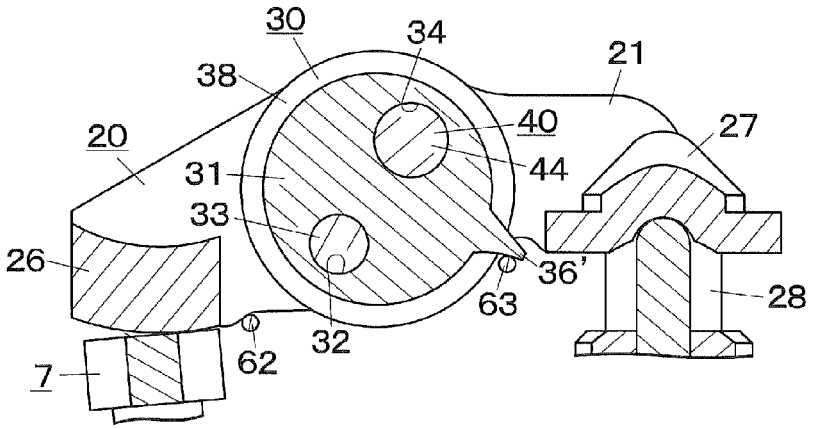
FIG. 7B is a side sectional view thereof.
Figure 7C:
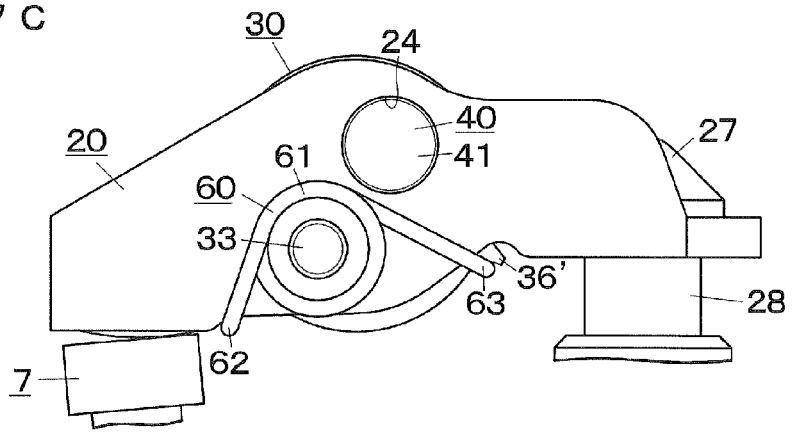
FIG. 7C is a side view thereof.
Figure 8:
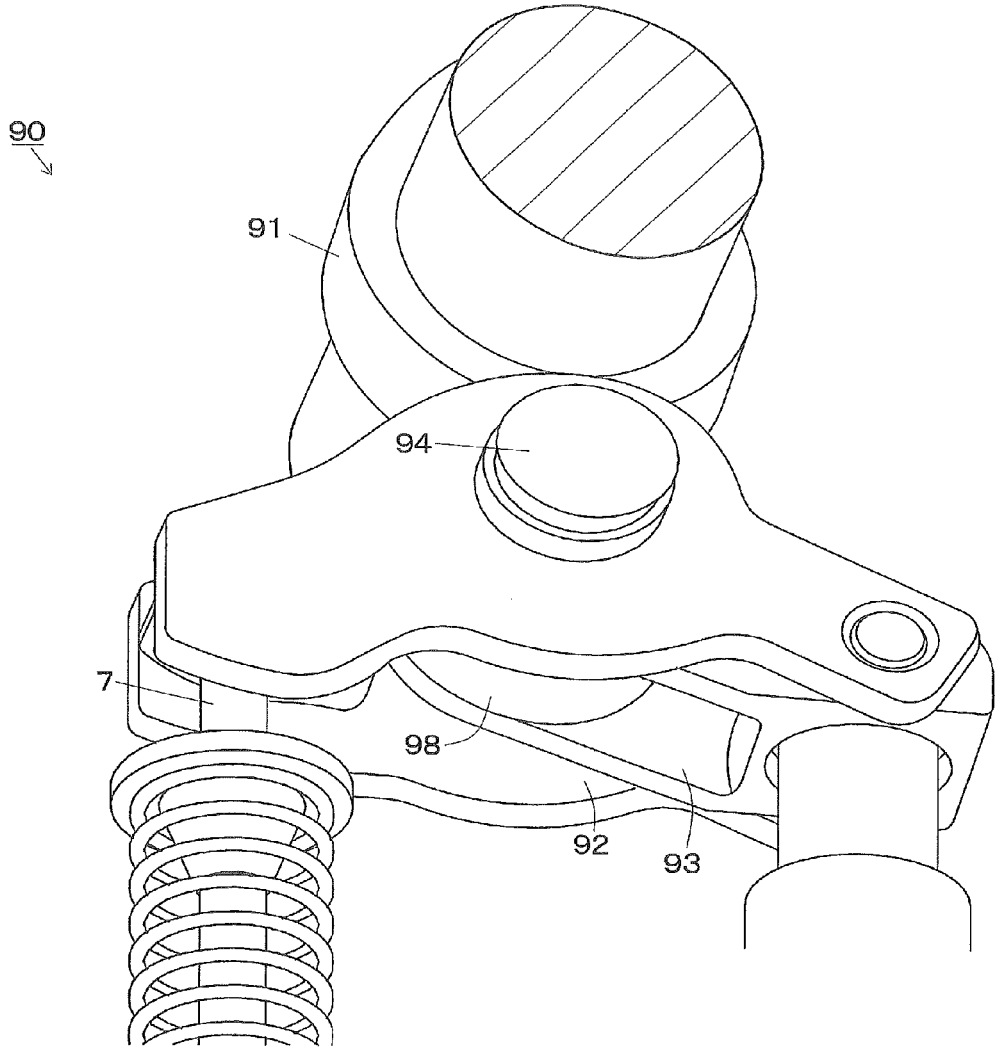
FIG. 8 PRIOR ART
FIG. 8 is a perspective view showing a variable valve mechanism of Related Art Document 1.
Figure 9:
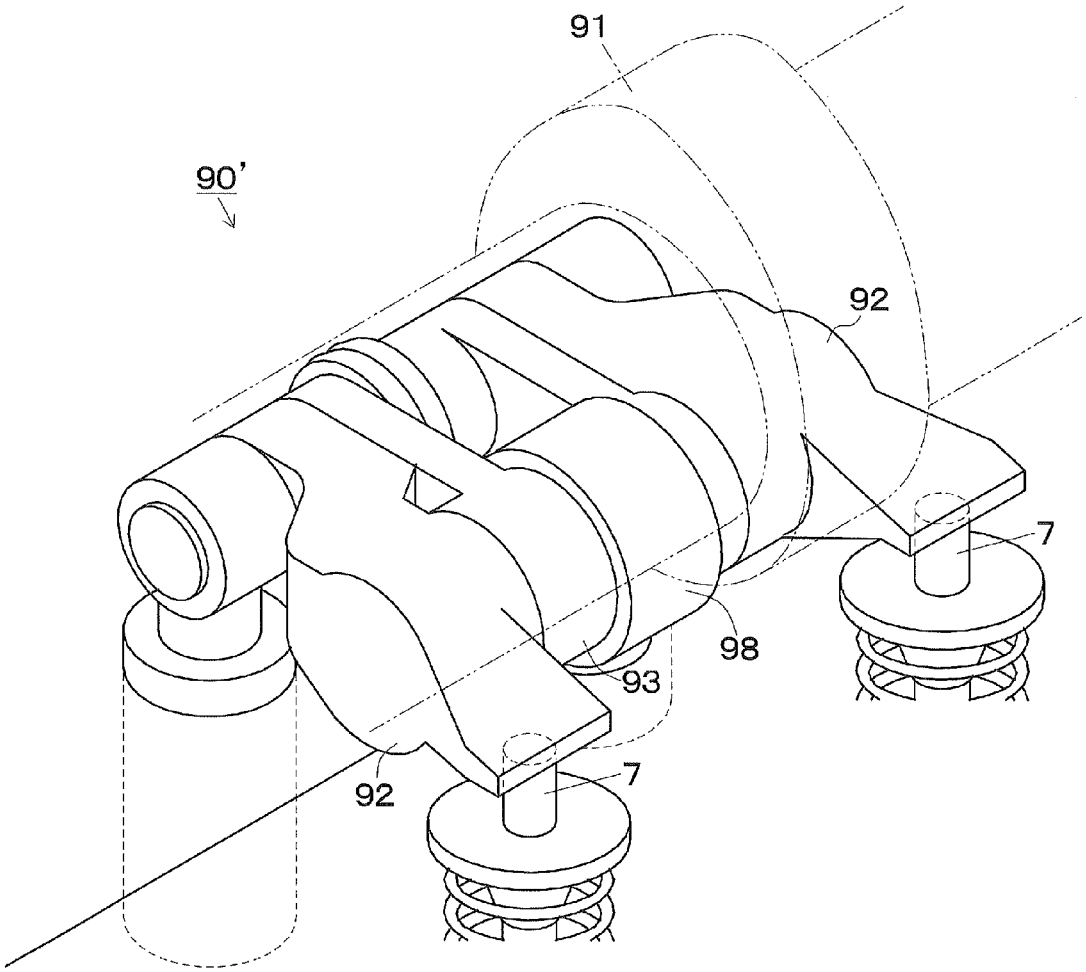
FIG. 9 is a perspective view showing a variable valve mechanism of Related Art Document 2.

A variable valve mechanism 9' of a second embodiment shown in FIGS. 7A to 7C is substantially similar to the first embodiment. The variable valve mechanism 9' of the second embodiment is different from the first embodiment in that the recess 35 and the pressed protrusion 36 are not provided in the swing pin 31, but instead a pressed protrusion 36' protruding in a radial direction of the swing pin 31 is provided in a left part of the swing pin 31, in that the one end 62 of the torsion coil spring 60 contacts a lower surface of the left outer arm portion 21 and the other end 63 thereof contacts a lower surface of the pressed protrusion 36', and in that the weight-reducing hole 37 is not provided. The variable valve mechanism 9' of the second embodiment is otherwise similar to the first embodiment. Effects similar to those of the first embodiment can be obtained by the second embodiment.

The present invention is not limited to the first and second embodiments, and may be modified and embodied in various other forms without departing from the spirit and scope of the invention. For example, the present invention may be modified as shown in the following first to third modifications.

First Modification

In the first embodiment, the recess 35 and the pressed protrusion 36 may be provided on a right side surface (on the second coupling member 51 side) of the swing pin 31 instead of being provided on the left side surface (on the first coupling member 41 side) of the swing pin 31. The support pin 33 may be provided so as to protrude rightward from the output arm 20 instead of protruding leftward from the output arm 20. The torsion coil spring 60 may be fitted on a right end of the support pin 33 instead of being fitted on the left end of the support pin 33. The one end 62 of the torsion coil spring 60 may be provided so as to contact an outer peripheral surface of the second coupling member 51 instead of contacting the outer peripheral surface of the first coupling member 41.

Second Modification

In the second embodiment, the pressed protrusion 36' may be provided in a right part of the swing pin 31 instead of being provided in the left part of the swing pin 31. The support pin 33 may be provided so as to protrude rightward from the output arm 20 instead of protruding leftward from the output arm 20. The torsion coil spring 60 may be fitted on a right end of the support pin 33 instead of being fitted on the left end of the support pin 33. The one end 62 of the torsion coil spring 60 maybe provided so as to contact the lower surface of the right outer arm portion 31 instead of contacting the lower surface of the left outer arm portion 21.

Third Modification

In the first and second embodiments, the maximum displacement amount by which the input arm 30 can be displaced relative to the output arm 20 may be set at less than the lift amount of the rotary cam 10 so as to drive the valve 7 in a smaller drive amount than that in the coupled state when in the non-coupled state, instead of halting the driving of the valve 7.

REFERENCE SIGNS LIST 7 valve
9 variable valve mechanism
10 rotary cam
20 output arm
30 input member
31 swing pin
33 support pin
38 input roller
40 switching device
44 first switch pin
54 second switch pin
58 displacing device
A rotation center of input roller
B center of relative swinging movement
C center of switch pin

The invention claimed is:

1. A variable valve mechanism of an internal combustion engine, comprising:
a rotary cam that rotates according to rotation of the internal combustion engine;
an output arm that is swingably provided, and that drives a valve when swinging;
an input member that is provided so as to be swingable relative to the output arm, and that contacts the rotary cam; and
a switching device that switches between a coupled state where the input member is coupled to the output arm so as not to allow the input member to swing relative to the output arm, and a non-coupled state where the coupling between the input member and the output arm is released so as to allow the input member to swing relative to the output arm, wherein
the variable valve mechanism changes a drive state of the valve by the switching operation,
the input member comprises an annular input roller that contacts the rotary cam, and a swing pin that is inserted into the input roller so as to rotatably support the input roller and that swings relative to the output arm when in the non-coupled state, and
a center of the relative swinging movement is located at a position different from a rotation center of the input roller which is located inward of the input roller.

2. The variable valve mechanism according to claim 1, wherein
the switching device comprises a switch pin that extends in both the swing pin and the output arm when in the coupled state and that does not extend in both the swing pin and the output arm when in the non-coupled state, and
in the coupled state, a center of the switch pin is located at a position different from the center of the relative swinging movement which is located inward of the input roller.

3. The variable valve mechanism according to claim 2, wherein,
in the coupled states, the center of the relative swinging movement and the center of the switch pin are located on opposite sides of the rotation center of the input roller.

4. The variable valve mechanism according to claim 3, wherein
the swing pin is supported by the output arm via a support pin, and
a center of the support pin is the center of the relative swinging movement.

5. The variable valve mechanism according to claim 4, wherein
the support pin protrudes laterally from the output arm, and
a torsion coil spring that biases the input member against the rotary cam when in the non-coupled state is fitted on the laterally protruding portion of the support pin.

6. The variable valve mechanism according to claim 2, wherein
the swing pin is supported by the output arm via a support pin, and
a center of the support pin is the center of the relative swinging movement.

7. The variable valve mechanism according to claim 6, wherein
the support pin protrudes laterally from the output arm, and
a torsion coil spring that biases the input member against the rotary cam when in the non-coupled state is fitted on the laterally protruding portion of the support pin.

8. The variable valve mechanism according to claim 1, wherein
the swing pin is supported by the output arm via a support pin, and
a center of the support pin is the center of the relative swinging movement.

9. The variable valve mechanism according to claim 8, wherein
the support pin protrudes laterally from the output arm, and
a torsion coil spring that biases the input member against the rotary cam when in the non-coupled state is fitted on the laterally protruding portion of the support pin.

* * * * *